United States Patent [19]

Coll-Palagos

[11] 4,092,448

[45] May 30, 1978

[54] METHOD OF PLATING METALS

[75] Inventor: Miguel Coll-Palagos, Rye, N.Y.

[73] Assignee: Stauffer Chemical Company, Westport, Conn.

[21] Appl. No.: 743,551

[22] Filed: Nov. 22, 1976

Related U.S. Application Data

[62] Division of Ser. No. 569,526, Apr. 18, 1975, abandoned. abandoned.

[51] Int. Cl.[2] ..... C25D 5/50

[52] U.S. Cl. ..... 427/383 D; 204/37 R; 204/37 T; 428/650; 428/652; 428/658; 427/405

[58] Field of Search ..... 204/37 R, 37 T, 40; 427/383 D, 405, 406; 428/647, 648, 651, 652, 658, 667, 671, 675; 228/208, 209, 210

[56] References Cited

U.S. PATENT DOCUMENTS

| | | | |
|---|---|---|---|
| 2,428,318 | 9/1947 | Nachtman | 204/37 T |
| 2,429,222 | 10/1947 | Ehrhardt | 204/37 R |
| 2,995,814 | 8/1961 | Chamness | 204/37 R |
| 3,282,659 | 11/1966 | Harrover | 204/40 |
| 3,455,014 | 7/1969 | Beyer | 204/40 |

*Primary Examiner*—John H. Mack
*Assistant Examiner*—William Leader
*Attorney, Agent, or Firm*—William R. Robinson

[57] ABSTRACT

A method of plating a metallic substrate by coating said substrate with a specific metallic system; plating at least one metal onto the coating; and heating the coated and plated metallic substrate to a temperature that effects a bonding of said metallic substrate to said coating and the plated metal. The method is utilized to plate metals onto metal substrates; including substrates such as aluminum and zinc.

6 Claims, No Drawings

METHOD OF PLATING METALS

This is a division, of application Ser. No. 569,526 filed Apr. 18, 1975, now abandoned.

BACKGROUND OF THE INVENTION

1. Field of the Invention

This invention relates, in general, to a method of plating metals and particularly concerns a method of bonding a metallic substrate to an intermediate metallic coating and a plated metal surface.

2. The Prior Art

Numerous methods of plating metals onto metallic substrates are known. The utilities of those methods generally include decorative and functional applications.

Certain metallic substrates are traditionally difficult to plate with an adherent metal coating. For example, aluminum and aluminum alloys (hereinafter collectively referred to as "aluminum") are characterized with numerous plating difficulties; including problems of adhesion of metal coatings. A solution to the problems inherent in plating aluminum is especially important due to present-day needs for light-weight vehicles that are energy saving. Increased quantities of aluminum are being utilized in such vehicles and there is a need to provide that aluminum with adherent coatings of decorative and functional metals.

Other metallic substrates such as zinc and zinc alloys (hereinafter collectively referred to as "zinc") are difficult to plate with metal coatings of good quality.

Methods of coating aluminum and methods of bonding various metals are described in U.S. Published patent application Ser. No. B 399,766 and in U.S. Pat. No. 3,854,892.

SUMMARY OF THE INVENTION

In accordance with the present invention, a method is provided wherein a metallic substrate is coated with a specific metallic system. At least one additional metal is then plated onto the metallic system coating (hereinafter referred to as the "intermediate metallic coating"). Pursuant to the theory of the present invention, the components and the concentrations of the components of said specific metallic system are selected from metallurgical phase diagrams at points on the liquidus. The liquidus temperature of the selected system must coincide with a temperature at which intermetallic compositions, defined herein as alloys or intermetallic compounds, can form both with said metallic substrate and said specific metallic system and with the first layer of metal that is plated on said intermediate metallic coating and said specific metallic system. When all of these parameters are met, the coated and plated metallic substrate is heated to effect a diffusion bonding wherein said metallic substrate is in diffused communication with said intermediate metallic coating and said intermediate metallic coating is in diffused communication with the plated metal.

Heat treatment can be carried out at about or below the liquidus temperature as long as a sufficient heating time is provided to allow diffusion to take place (i.e., to allow said intermetallic compositions to form). When diffusion takes place, a bonding of said metallic substrate to said intermediate metallic coating and said plated metal is effected. The metallic substrate is thus provided with an adherent, metal-plated surface that can withstand severe mechanical stress and environmental stress.

The utilities of the present invention are numerous and are limited only by the various decorative and functional uses that one skilled in the art can envision for plated metallic substrates. A variety of substrate metals can be plated in accordance with the method of the present invention; including metals that have heretofore been difficult to plate. Aluminum automobile bumpers and zinc diecastings, for example, can now be provided with an adherent, high-quality, metal-plated surface.

DETAILED DESCRIPTION OF THE INVENTION

In simplification, the process of the present invention is conducted as follows:

1. A metallic substrate is selected;
2. if necessary, the surface of said substrate is cleaned and any oxide layer is removed;
3. an approximate liquidus temperature that is suitable in view of the end use for the metal-plated metallic article is selected;
4. metallic compositions are selected from metallurgical phase diagrams on the basis of the selected liquidus temperature;
5. a functional or decorative metal is selected;
6. from said metallic compositions are selected specific metallic systems that will form, at about or below the liquidus temperature, intermetallic compositions with said metallic substrate and said functional or decorative metal;
7. one specific metallic system is coated on said metallic substrate thereby forming an intermediate metallic coating;
8. the functional or decorative metal (hereinafter referred to as "the plated metal") is plated on said intermediate metallic coating;
9. the coated and plated metallic substrate is heated to effect the formation of said intermetallic compositions thereby effecting diffusion bonding whereby said metallic substrate is in diffused communication with said intermediate metallic coating and said intermediate metallic coating is in diffused communication with the plated metal.

Various metallic substrates can be utilized in accordance with the present invention. The choice can depend upon economic factors, the end use of the metal plated metallic article or other factors that can be determined by one skilled in the art who practices the present invention. Suitable metallic substrates include but are not limited to the following metals and their alloys: aluminum, iron, steel, nickel, copper, zinc, tin and lead.

Various methods of coating the metallic substrate with the specific metallic system can be utilized. These methods include chemical and electrical plating and equivalent methods such as vapor deposition and others known to those skilled in the art. The various components of said specific metallic system, if coated onto the substrate separately, can each be coated according to various methods.

Some metallic substrates require special treatment such as pretreatment to prepare the surface for coating with said specific metallic system. Substrates comprised of aluminum, aluminum alloys, and zinc, for example, have a natural oxide layer. The oxide layer should be removed by pretreatment prior to coating.

Numerous methods for removing the oxide layer are known. Some of these methods are described in *Hand-*

*book der Galvanotechnik,* H. W. Dettner and J. Elze (C. H. Verlag, Munich, 1966) and *The Surface Treatment and Finishing of Aluminum,* S. Wernick and R. Pinner (Draper, 1973).

The thickness of said intermediate metallic coating can vary between about 0.005 mil and about 3 mils. That thickness will depend upon the diffusion coefficients of the components in said specific metallic system. For example, if the diffusion coefficients are high, a thicker coating can be utilized as diffusion time is reduced. The respective thicknesses of the various components of said intermediate metallic coating, when they are coated on separately, are approximately proportional to the concentrations of said components in said specific metallic system.

The specific metallic system is comprised of components selected on the basis of temperature points or lines on the liquidus of metallurgical phase diagrams. One skilled in the art who practices the present invention will first select a minimum liquidus temperature on the basis of the end use for the metal-plated metallic article. If that article is to be utilized in a heated atmosphere, for example, a minimum liquidus temperature that is higher than the temperature of that heated atmosphere will be selected.

Numerous combinations of metallic components having desired liquidus temperature characteristics are then selected from metallurgical phase diagrams.

It is well-known in the metallurgical art that phase diagrams for various metals or metallic compositions have a liquidus. The liquidus is a line or surface in a temperature-composition diagram indicating the equilibrium temperature of complete fusion when the metal or metallic composition is heated, or complete freezing when a liquid metal or metallic composition is cooled.

As indicated above, the phase diagrams are temperature-composition diagrams. Accordingly, when a minimum liquidus temperature is selected in accordance with the present invention, an infinite number of metallic compositions can be selected along the portion of the line or surface that lies at or above said minimum liquidus temperature.

In practical application of the theory of the present invention, the infinite variety of suitable metallic compositions is reduced to a finite number. Any metallic compositions that have liquidus temperatures below the minimum liquidus temperature are, of course, eliminated from consideration. Moreover, metallic compositions having liquidus temperatures that are too high for practical use, based upon heating-oven limitations for example, are also eliminated from consideration. A range of concentrations is thus left for the metallic compositions. For example, in a tin-nickel composition the liquidus temperature at 100% tin is about 231° C. and at 100% nickel is about 1455° C. If a minimum liquidus temperature of about 450° C. is selected and it is decided that liquidus temperatures over about 900° C. would be impractical, any tin-nickel phase diagram will show that tin-nickel compositions having between about 98% and about 85% tin will be suitable.

It is possible that a single metal would have the characteristics necessary to satisfy the requirements of said specific metallic system. It is also possible, however, that multi-component metallic systems could or would have to be utilized. The myriad of possible combinations of suitable metallic compositions will be apparent to one skilled in the art from the teachings of the present invention. Optimum systems can be selected on the basis of the teachings of the present invention and the literature.

After one or more metallic compositions have been selected, the characteristics of each composition must be determined with respect to its ability to form intermetallic compositions both with said metallic substrate and with the first layer of the plated metal. The formation of intermetallic compositions should occur at about the liquidus temperature or below the liquidus temperature. The following reference, among others, can be utilized to determine when intermetallic compositions will form: *Intermetallic Compounds,* J. H. Westbrook (Wiley, 1967).

It is apparent from the foregoing that not all metallic compositions that meet the required characteristics of liquidus temperature will necessarily be suitable to meet the second requirement of intermetallic composition formation. Any metallic composition that meets both requirements can be used as specific metallic systems in accordance with the present invention.

If said specific metallic system is comprised of more than one metallic component, the concentrations of these components, as explained above, will determine the liquidus temperature as seen from the appropriate metallurgical phase diagram. These components can be coated on the surface of said metallic substrate individually or in combination. When they are coated on individually, the thicknesses of their respective coatings will be approximately proportional to the concentrations of these components as dictated by the phase diagram. For example, a specific metallic system of 90% tin and 10% nickel could be coated on the metallic substrate in thicknesses of 0.09 mil and 0.01 mil, respectively.

A great deal of literature is available on metallurgical phase diagrams and the formation of intermetallic compositions. The following is a partial list of that literature: *Phase Stability in Metals and Alloys,* P. Rudman, J. Stringer and R. Jaffe (McGraw Hill, 1967); *Metals Reference Book,* C. J. Smith (Washington, 1962); and *Metals Handbook,* Vol. 8, (ASM Handbook Committee, 1973).

The metal to be plated onto said intermediate metallic coating, can be selected on the basis of decorative or functional factors. Other metals can be subsequently plated onto the first plated layer either before or after heat treatment. Functional criteria for selection of the first plated layer can be based upon the end use of the metal plated product or upon metallurgical factors with respect to providing an adherent layer of a metal that can subsequently be plated with the desired outer layer or any intermediate layers between said first plated layer and said outer layer of metal. For example, copper is a functional metal in that it can easily be plated with decorative metals, such as chromium, by conventional means. Thus, for example, providing an aluminum substrate with an adherent layer of copper will make it possible to effectively provide a high-quality, chrome-plated surface on aluminum.

Plating is generally carried out under conventional electrolytic methods or equivalent methods that will provide a metallic layer of the required thickness and uniformity that is dictated by the end use for the metal-plated metallic article. Methods of electrolytic plating are described in numerous publications including the following: *Modern Electroplating,* F. A. Lowenheim (Wiley, 1974) and *Handbook der Galvanotechnik,* H. W. Dettner and J. Elze (C. H. Verlag, Munich, 1966).

Various factors will determine the time and temperature at which the coated and plated metallic substrate will be heat treated. The diffusion that takes place upon heat treatment is a function of time and temperature. As temperatures are lowered, the time required for diffusion increases. As discussed previously, the diffusion that takes place according to the present invention causes the formation of intermetallic compositions at the interfaces of said intermediate metallic coating with said metallic substrate and with the first layer of the plated metal. This diffusion brings about the adherent bonding of said metallic substrate to said intermediate metallic coating and the plated metal.

Time and temperature characteristics for diffusion of the various metals that can be utilized in accordance with the present invention are available in the literature. Some of this literature is listed above under the discussion of intermetallic compositions.

In practical application, factors such as the heat capacity of available heating ovens and the most efficient manufacturing time of heat treatment must be considered. If, for example, the available oven operates most efficiently at 300° C. and not more than 30 minutes can be allocated to heat treatment, a specific metallic system that is operable under these parameters will have to be used. With these parameters in mind, it is clear from the foregoing that the 98% tin — 2% nickel system could be utilized as the intermediate metallic coating in providing an aluminum substrate with an adherent layer of plated copper.

Two exemplary specific metallic systems for aluminum substrates comprise: (1.) between about 0.01% and about 99.99% nickel and between about 99.99% and about 0.01% tin; and (2.) between about 0.01% and about 99.98% zinc and between about 0.01% and about 99.98% tin and between about 0.01% and about 99.98% copper.

An exemplary specific metallic system for zinc substrates comprises between about 0.01% and about 99.99% copper and between about 0.01% and about 99.99% tin.

Numerous other specific metallic systems for aluminum, zinc and other substrates can easily be selected by one skilled in the art on the basis of the foregoing disclosure.

The following examples are submitted to illustrate but not to limit the present invention.

EXAMPLE I

A piece of 7046 aluminum alloy was utilized as the metallic substrate. The selected piece had about 10 square inches of plating area. This alloy is of high strength and is used in aluminum bumpers for automobiles. The composition of the 7046 alloy is: Cu — 0.1%; Mn — 0.3%; Mg — 1.3%; Cr — 0.12%; Zn — 7.0%; Cr — 0.12%; Ti — 0.03%; Si — 0.4% maximum impurities; and Fe — 0.35% maximum impurities.

The 7046 alloy was plated in accordance with the present invention by treatment according to the following sequential steps:

1. cleaning in perchloroethylene bath followed by air drying and degreasing in a mild alkaline cleaner;
2. cold water rinse;
3. immersion in a 3% phosphoric acid bath for 3 minutes at 70° C. for neutralizing and mild etching;
4. cold water rinse
5. immersion in fluoride-nitric acid bath having the composition:
   60% by volume of 67% concentrated nitric acid
   15 grams/liter ammonium bifluoride for 1 minute at room temperature;
6. cold water rinse;
7. hydrolysis for 1 minute at 70° C. in an aqueous solution containing 50 grams/liter of citric acid and 50 grams/liter of boric acid to remove insoluble aluminum salts from the surface;
8. cold water rinse;
9. tin activation for 1 minute 15 seconds at 30° C. in a solution containing:
   37.5 grams/liter potassium stannate trihydrate ($K_2SnO_3.3H_2O$)
   22.5 grams/liter sodium gluconate ($NaC_6H_{11}O_7$)
   3.75 grams/liter potassium hydroxide;
10. cold water rinse;
11. electroless nickel plating for 15 minutes at 85° C. in a solution containing:
    25 grams/liter nickel sulfate hexahydrate ($NiSO_4.6H_2O$)
    1 gram/liter sodium lignosulfonate;
    22 grams/liter sodium hypophosphite ($NaH_2PO_2.H_2O$)
    9 grams/liter nitrilotriacetic acid, trisodium salt mono hydrate
    13 grams/liter succinic acid;
12. cold water rinse;
13. electrolytic copper plating for 3 minutes at 14.4 amperes per square foot and then for 15 minutes at 43.2 amperes per square foot in a solution containing: 30 ounces/gallon copper sulfate; 5.5 fluid ounces/gallon sulfuric acid; and 30 milligrams/liter hydrochloric acid;

This gave uniform plating with no blistering;

14. air drying at room temperature;
15. heat treatment for 30 minutes at 270° C.
16. cold water quench.

Adhesion of the copper was excellent. Attempts to separate the copper layer from the substrate by filing, knifescratching and lifting were all unsuccessful.

EXAMPLE II

The same procedure as in Example I was followed on a piece of 7046 aluminum except that step 13 was followed by a cold water rinse and then the following steps were carried out:

14*a.* Electrolytic nickel plating for 5 minutes at 74 amperes per square foot and 50° C. in a solution containing:
300 grams/liter $NiSO_4.H_2O$
60 grams/liter $NiCl_2.6H_2O$;

14*b.* Cold water rinse;

14*c.* Electrolytic chrome plating for 3 minutes at 93 amperes per square foot and 45° C. in a solution containing
300 grams/liter chromic acid
3 grams/liter sulfuric acid;

14*d.* Air drying at room temperature.

Steps 15 and 16 were than carried out according to Example I. Adhesion was excellent although there was some stress blistering on the nickel-chrome layer.

EXAMPLE III

The same procedure as in Example I was followed on a piece of 7046 aluminum except that after step 12, the following steps were carried out:

12*a.* Bright acid copper was plated from a standard solution to a thickness of 0.7 mil;

12*b.* Cold water rinse;
12*c.* Semi-bright nickel was plated from a standard solution to a thickness of 0.7 mil;
12*d.* Cold water rinse;
12*e.* Bright nickel was plated from a standard solution to a thickness of 0.3 mil;
12*f.* Cold water rinse;
12*g.* Microcracked chrome was plated from a standard solution to a thickness of 0.02 mil;

Steps 14, 15 and 16 were then carried out according to Example I. Adhesion was excellent with no blistering.

The sample was subject to a 48 hour salt spray. No blistering or corrosion was evident.

The sample also passed the standard 180 foot-pound drop test.

EXAMPLE IV

The same procedure as in Example I was followed on a piece of 7046 aluminum except that tin activation step 9 was carried out at 26° C.; electroless nickel step 11 was carried out for 6 minutes at 90° C.; this was followed by step 12.

After step 12, the following procedures were carried out:

13*a.* Bright acid copper was plated from a standard solution for 20 minutes at 50 amperes per square foot;
13*b.* Cold water rinse;
13*c.* Immersion in 50% HCl for 15 seconds;
13*d.* Cold water rinse;
13*e.* Electrolytic nickel plating for 5 minutes at 60 amperes per square foot using the same solution as step 14*a.* of Example II;
13*f.* Cold water rinse;
13*g.* Electrolytic chrome plating at 200 amperes per square foot for 3 minutes using the same solution as step 14*c.* of Example II;
13*h.* Air drying at room temperature.

A knife incision was then made to peel back a portion of the plated surface. This was followed by heat treatment at 275° C. for 30 minutes and then cold water quenching. The surface could not thereafter be peeled by a knife incision. Also, heavy hammering and striking the plated surface with the chisel end of a hammer failed to cause peeling or cracking of the plated surface.

EXAMPLE V

Samples of 7046 aluminum prepared according to Example IV, both before and after heat treatment were sectioned and analyzed by scanning electron microscope and X-ray distribution. The heat treated samples were clearly distinguishable from the samples than had not been heat treated due to the diffusion that had taken place as the result of heat treatment.

EXAMPLE VI

A modified procedure according to Example I was followed on a piece of 1100 aluminum alloy (nominal chemical composition: 99% minimum purity aluminum and 0.12% copper). Steps 1–8 were carried out followed by the steps:

8*a.* Displacement zinc plating for 1 minute at 22° C.;
8*b.* Cold water rinse;
8*c.* Electrolytic tin-copper plating for 1 minute at 36 amperes per square foot and 52° C. in a solution containing: 28.2 grams/liter copper pyrophosphate; 41.1 grams/liter tin pyrophosphate; 167 grams/liter sodium-potassium pyrophosphate; and 20 grams/liter ammonium oxalate (the solution had pH 9);
8*d.* Cold water rinse;
8*e.* Bright acid copper was plated from a standard solution for 20 minutes at 54 amperes per square foot and 23° C.;
8*f.* Cold water rinse;
8*g.* Electrolytic nickel plating at 72 amperes per square foot for 5 minutes at 54° C. using the same solution as in step 14*a.* of Example II;
8*h.* Air drying at room temperature;
8*i.* Heat treatment for 30 minutes at 280° C.;
8*j.* Cold water quench.

The resulting product had no blistering and excellent adhesion.

EXAMPLE VII

A modified procedure according to Examples I and VI was followed on a piece of 2024 aluminum alloy (nominal chemical composition: 4.5% copper, 0.6% manganese, 1.5% magnesium, remainder aluminum). Steps 1–8 of Example I were carried out followed by steps 8*a.*–8*j.* of Example VI with the exception that 8*c.* was conducted for 45 minutes at 24 amperes per square foot and 51° C.; 8*e.* was conducted at 48 amperes per square foot; 8*g.* was conducted at 68 amperes per square foot; and 8*i.* was conducted at 275° C.

Some blistering occurred. However, on areas where blistering did not occur, adhesion was excellent.

EXAMPLE VIII

A modified procedure according to Examples I and VI was followed on a piece of 3003 aluminum alloy (nominal chemical composition: 0.12% copper, 1.2% manganese, remainder aluminum). Steps 1–8 of Example I were carried out followed by steps 8*a.*–8*j.* of Example VI with the exception that 8*a.* was conducted for 30 seconds at 24° C.; 8*c.* was conducted for 2 minutes at 12 amperes per square foot and 57° C.; 8*e.* was conducted at 48 amperes per square foot; and 8*g.* was conducted for 10 minutes at 48 amperes per square foot and 54° C.

Some blistering occurred, however, adhesion was otherwise excellent. (Peeling could not be achieved by a knife incision.)

EXAMPLE IX

A modified procedure according to Examples I and VI was followed on a piece of 6061 aluminum alloy (nominal chemical composition: 0.6% silicon, 0.25% copper, 1.0% magnesium, 0.2% chromium, remainder aluminum). Steps 1–8 of Example I were carried out followed by steps 8*a.*–8*j.* of Example VI with the exception that 8*c.* was conducted for 2 minutes at 12 amperes per square foot and 51° C.; 8*e.* was conducted at 48 amperes per square foot; and 8*g.* was conducted at 48 amperes per square foot and 53° C.

Some small blisters developed but adhesion was excellent as indicated by the inability to peel the plated metal away from the substrate with the use of a knife.

EXAMPLE X

A modified procedure according to Examples I and VI was followed on a piece of 7075 aluminum alloy (nominal chemical composition: 1.6% copper, 2.5% magnesium, 0.3% chromium, 5.6% zinc, remainder aluminum). Steps 1–8 of Example I were carried out followed by steps 8*a.*–8*j.* of Example VI with the exception that 8*c.* was conducted at 24 amperes per square foot and 51° C.; 8*e.* was conducted at 48 amperes per square foot; and 8*g.* was conducted for 10 minutes at 48 amperes per square foot.

Adhesion was excellent.

EXAMPLE XI

A piece of 7046 aluminum alloy of 2½ square inches surface area was treated according to steps 1–8 of Example I. This was followed by the steps:

9*a.* A tin fluoborate strike was carried out for 45 seconds at a total current of 0.5 amperes and 24° C. in a solution containing:
97 grams/liter tin fluoborate $Sn(BF_4)$
100 grams/liter fluoboric acid $HBF_4$
2.5 grams/liter β-naphtol
5.0 grams/liter gelatin
The solution had a pH of 0.1;

9*b.* Cold water rinse;

9*c.* Electrolytic tin-copper plating for 3 minutes at a total current of 0.5 amperes and 52° C. using the same solution as in step 8*c.* of Example VI;

9*d.* Cold water rinse;

9*e.* Bright acid copper was plated from a standard solution for 10 minutes at a total current of 2 amperes and 24° C.;

9*f.* Cold water rinse (A knife incision at this point was used to peel-back part of the plated metal.);

9*g.* Heat treatment for 30 minutes at 275° C.;

9*h.* Cold water quench.

Adhesion was excellent. The plated metal could not be peeled further with the knife.

EXAMPLE XII

A 2 inch by 2 inch piece of zinc diecasting having the composition: 0.75–1.25% copper, 3.5–4.3% aluminum, 0.3–0.8% magnesium, 0.1% maximum iron, 0.005% maximum lead, 0.004% maximum cadmium, 0.003% maximum tin, remainder 99.99% pure zinc, was treated as follows:

1. Soak cleaning in perchloroethylene;
2. Air drying at room temperature;
3. Degreasing in a mild alkaline cleaner for 1 minute at 70° C.;
4. Cold water rinse;
5. Immersion in a 3% phosphoric acid bath for 1 minute at 70° C.;
6. Cold water rinse;
7. Activation for 30 seconds at 24° C. in a solution containing:
   20% by volume in water of 85% phosphoric acid
   105 grams/liter ammonium bifluoride;
8. Cold water rinse;
9. Tin fluoborate strike for 1½ minutes at a total current of 3 amperes and 24° C. using the same solution as in step 9*a.* of Example XI;
10. Cold water rinse;
11. Electrolytic tin-copper plating for 2 minutes at a total current of 3 amperes and 51° C. using the same solution as in step 8*c.* of Example VI;
12. Cold water rinse;
13. Bright acid copper plating from a standard solution for 15 minutes at a total current of 5 amperes and 24° C.;
14. Cold water rinse;
15. Bright nickel plating from a standard solution for 6 minutes at a total current of 5 amperes and 54° C.;
16. Cold water rinse (A knife incision at this point was used to peel-back part of the plated metal.)
17. Heat treatment for 30 minutes at 275° C.;
18. Cold water quench.

There was no blistering. Adhesion was excellent. The plated metal could not be peeled further with the knife.

Having set forth the general nature and some examples of the present invention, the scope is now particularly set forth in the appended claims.

What is claimed is:

1. A method of plating an aluminum substrate comprising:

coating said aluminum substrate with an intermediate metallic coating comprising between about 0.01% and about 99.99% nickel and between about 99.99% and about 0.01% tin and having a thickness between about 0.005 mil and about 3 mils;

plating a metal selected from the group consisting of copper and nickel onto the intermediate metallic coating; and heating the coated and plated aluminum substrate to form an alloy between said aluminum substrate and said intermediate metallic coating and to form an alloy between said intermediate metallic coating and the plated metal.

2. The method of claim 1 further comprising the steps of plating additional metals onto the plated metal.

3. A method of plating an aluminum substrate comprising:

coating said aluminum substrate with an intermediate metallic coating comprising between about 0.01% and about 99.98% zinc and between about 0.01% and about 99.98% tin and between about 99.98% and about 0.01% copper and having a thickness between about 0.005 mil and about 3 mils;

plating a metal selected from the group consisting of copper and nickel onto the intermediate metallic coating; and heating the coated and plated aluminum substrate to form an alloy between said aluminum substrate and said intermediate metallic coating and to form an alloy between said intermediate metallic coating and the plated metal.

4. The method of claim 3 further comprising the steps of plating additional metals onto the plated metal.

5. A method of plating an aluminum substrate comprising:

coating said aluminum substrate with an intermediate metallic coating comprising between about 0.01% and about 99.99% copper and between about 99.99% and about 0.01% tin and having a thickness between about 0.005 mil and about 3 mils;

plating a metal selected from the group consisting of copper and nickel onto the intermediate metallic coating; and heating the coated and plated aluminum substrate to form an alloy between said aluminum substrate and said intermediate metallic coating and to form a alloy between said intermediate metallic coating and the plated metal.

6. The method of claim 5 further comprising the steps of plating additional metals onto the plated metal.

* * * * *